United States Patent [19]

Stockmeyer

[11] Patent Number: 4,495,900

[45] Date of Patent: Jan. 29, 1985

[54] METHANE STORAGE FOR METHANE-POWERED VEHICLES

[75] Inventor: Rolf Stockmeyer, Linnich-Tetz, Fed. Rep. of Germany

[73] Assignee: Kernforschungsanlage Jülich GmbH, Jülich, Fed. Rep. of Germany

[21] Appl. No.: 435,492

[22] Filed: Oct. 20, 1982

Related U.S. Application Data

[63] Continuation-in-part of Ser. No. 158,113, Jun. 10, 1980, abandoned.

[30] Foreign Application Priority Data

Jun. 11, 1979 [DE] Fed. Rep. of Germany ..... 2923561
May 13, 1980 [DE] Fed. Rep. of Germany ..... 3018196

[51] Int. Cl.[3] ..... F02B 43/04

[52] U.S. Cl. ..... 123/1 A; 123/3; 123/DIG. 12; 123/527

[58] Field of Search ..... 123/1 A, 3, DIG. 12, 123/527; 62/48; 55/75, 62; 423/375

[56] References Cited

U.S. PATENT DOCUMENTS 3,828,736 8/1974 Koch ..... 123/1 A
3,976,034 8/1976 Shinohara et al. ..... 123/1 A
4,016,836 4/1977 MacKay et al. ..... 123/3
4,214,699 7/1980 Buchner et al. ..... 123/DIG. 12

FOREIGN PATENT DOCUMENTS 1013632 7/1977 Canada ..... 123/1 A

OTHER PUBLICATIONS

German Handbook, "Hütte", vol. 1, (1941), pp. 616–617, 624–625, 950–951, 1056–1057.
USA–"Zeolite Molecular Sieves", Donald Beck, (Wiley).
Great Britain, "Proceedings of the Sixth International Congress on Catalysis", (1976).

*Primary Examiner*—Ethel R. Cross
*Attorney, Agent, or Firm*—Karl F. Ross

[57] ABSTRACT

A methane-powered vehicle can utilize methane which is stored as the fuel in a pressurizable tank containing a solid filling which enables a packing density of methane in adsorbed or otherwise trapped form to exceed 10 times the density of the methane at room temperature and a pressure of about 10 bar. The filling can be readily charged with the methane or can release the methane for powering the vehicle.

10 Claims, 2 Drawing Figures

METHANE STORAGE FOR METHANE-POWERED VEHICLES

CROSS REFERENCE TO COPENDING APPLICATION

This application is a continuation in part of Ser. No. 158,113 filed June 10, 1980, now abandoned.

FIELD OF THE INVENTION

My present invention relates to the storage of methane and, more particularly, to the storage of methane for methane-powered vehicles and especially to a pressurizable vessel and material designed to store methane for this purpose.

BACKGROUND OF THE INVENTION

Methane has been proposed as a fuel for Otto-cycle engines or motors because, like hydrogen, it has high anti-knock qualities and produces an exhaust gas which is particularly free from toxic, noxious or otherwise detrimental components. In fact, like hydrogen, methane has been considered a particularly effective fuel for such internal-combustion engines by contrast with higher hydrocarbons (see for example the German textbook HUTTE, Vol. I, Verlag Wilhelm Ernst, Berlin 1941).

A particular difficulty is encountered, however, in selecting fuels for powering internal-combustion engines for automotive vehicles, namely, the storage of the fuel in sufficient volume and safety to permit wide spread use. For the most part, because of that storage problem, there has been no major shift away from higher hydrocarbons to other fuels potentially constituting more effective and/or environmentally favorable energy sources.

Most potential fuels which are gaseous at room temperature and pressure cannot be stored in sufficient volume and in a limited space to power a vehicle so that it will have a satisfactory range, except under extremely high pressures and at very low temperatures. Such low temperatures are difficult to generate on vehicles and high pressures are dangerous.

Hydrogen, however, has been the subject of considerable research with these problems in mind and the technology for storing hydrogen at relatively low pressures and at noncryogenic temperatures has advanced to a significant degree. For example, hydrogen can be stored in a tank or other vessel by packing the vessel with hydride-forming substances which effectively chemically bond the hydrogen or store the hydrogen as interstitial hydrides within a crystal or grain structure.

The hydrogen is stored in this mass by feeding it under pressure to the tank and is liberated from the mass by reducing the pressure and/or heating the mass. Particularly effective hydride formers are Fe-Ti alloys.

Analogous masses for the storage of methane have not been proposed nor am I aware of any detailed study heretofore of the problem as applied to methane because, apparently, of a prejudice in the art that such approaches would not be successful. Indeed, there has not been any major progress or even detailed study in the use of methane as a fuel for powering the internal-combustion engines of automotive vehicles.

In German patent document (published application-Offenlegungsschrift) DE-OS No. 23 02 403 there are described efforts to permit the storage of gases, among which methane is mentioned, for use in powering automotive vehicles by providing a tank or vessel with an adsorbent for the gas. The adsorbent is capable of picking up methane at low pressures; the stored gas volume can be increased, according to the publication, by 78% with a pressure of 70 kg/cm$^2$ which could be raised still higher for a further augmentation of storage capacity. These values are so unattractive that the reason for the lack of any significant development in the use of methane as a motor-vehicle fuel is readily apparent.

OBJECTS OF THE INVENTION

It is the principal object of my present invention to extend the principles of the above-mentioned application and provide a storage tank for methane which will overcome the disadvantages of prior systems and, in particular, will allow the use of methane as a practical motor-vehicle fuel.

Another object of the present invention is to provide an improved method of storing methane and, collateral thereto, of operating or driving a motor vehicle whereby, at reasonable pressures, relatively large volumes of methane can be stored in a given space and both the storage and the retrieval of the methane can be effected economically.

Still another object of my invention is to provide a low-cost, light-weight system for the storage of methane at reasonable temperatures and pressures, particularly for use in powering internal-combustion engines of automotive vehicles.

It is also an object of the invention to provide an improved material for the storage of methane.

SUMMARY OF THE INVENTION

These objects and others which will become apparent hereinafter are attained by the present invention, which is based upon my discovery that certain solids constitute adsorbers or methane-storage materials capable of providing extremely high methane-packing densities at reasonable pressures and at room or ambient temperatures.

Reference will be made herein to the methane-packing density and hence to the degree of compression, compaction or consolidation of the methane by which is meant the ratio between the methane content of a given tank volume, which is first filled with the storage material, and the methane content of the same tank volume without storage material filled with methane at the same temperature and pressure.

I have found that there are a number of solids satisfactory for use as fillings for the tank which provide a $CH_4$ packing density v (at about 10 bar), with respect to the empty tank, of about 10 at room temperature. The tank provided for this purpose need only have a design pressure of about 15 bar, which means that its wall thicknesses, seams and other structural parameters need not be dimensioned to withstand substantially higher pressures so that the overall assembly is of extremely light weight.

Minimum methane packing densities v of about 10 can be obtained with materials whose lattice structures of crystalline or grain configuration are capable of reversibly trapping the methane molecules. Such materials include those whose lattice structure permits penetration of the methane molecule to the interior of the solid mass and which have an inner surface activity with respect to the methane molecule such as to allow surface adhesion at least to the extent necessary to augment the trapping effect.

As particularly advantageous materials for this purpose I may use, for example, zoelites of known cage-like lattice structure of the general compositional formula $Al_2O_3.xSiO_2.(Li_a,Na_b,K_c,Ca_d,Ba_e)O$ where x ranges between 2 and 7 and is preferably less than 3; a, b and c are each 0, 1 or 2, and d and e are 0 or 2, respectively. These materials are of comparatively low cost and low specific gravity while having an effective storage capacity for the purposes of the present invention. Best results are obtained with type-X zeolite of the Faujasit type-A zeolite as described, for example, in D. W. Breck, *Zeolite Molecular Sieves,* J. Wiley, New York, 1974, pp. 29–133 and 593–725.

More specifically, I prefer to use a calcium-exchanged zeolite of the Faujasit type in a bulk density of about 1 g/cm$^3$ but in granules or particles of a full spectrum of particle sizes which permits the packing density of methane to reach the neighborhood of 10 at a pressure of 10 bar at room temperature, in contrast to commercial, uniform-size material of the same composition which can have a packing density of 5.1 at 10 bar. The interstitial openings have a mean dimension of 5 Angstrom units and their chemical composition corresponds to $CaO.Al_2O_3.2SiO_2$.

Advantageously, the zeolite material is compacted but binder-free and can be formed by the compaction of broken crystals of a zeolitic material which are compressed prior to use at a pressure of about 1 metric ton per cm$^2$.

The zeolitic material can also be compacted by subjecting it to a temperature above 300° C. and a pressure in excess of 50 bar. For example, the degassed zeolite, in deformable shells or sleeves, can be brought to an elevated temperature within the stability range of the crystal lattice, e.g. about 600° C., and subjected to compression at pressures of about 100 bar to form a compact pressed body of the high storage capacity required by the present invention.

I have found, quite surprisingly, that with compacts of a density of at least 0.7 g/cm$^3$ the methane-storage capacity is markedly increased by comparison with the same zeolite in particulate form prior to such compaction, and further that the methane-storage capacity can be increased still further with compacts of a density in excess of 1 g/cm$^3$. These results are surprising because one would normally expect maximum storage to be associated with maximum subdivision and minimum compactness because of the greater ratio of apparent surface area/volume characterizing increased subdivision.

While the system of the present invention best operates with a pressure up to 10 bar, it appears to be advantageous to utilize tanks having a pressure capacity of say 15 bar for safety purposes and because tanks dimensioned to resist such pressure levels are commercially available, e.g. as butane or propane tanks.

The invention, apart from its method aspects, also comprehends the methane-storage materials, namely, the zeolite compacts with a density in excess of 0.7 and preferably in excess of 1 g/cm$^3$.

I have found it to be advantageous to press the zeolitic materials into rods or bars dimensioned and shaped to fill the tank or vessel to the greatest possible extent. The bars or rods can thus have different diameters and, in the case of round rods, may have a ratio of substantially 1:0.4 between their largest and smallest diameters.

When the tank has a polygonal cross-section, it can be filled with bars of geometrically similar polygonal cross-section, e.g. in the form of triangular or hexagonal prisms. The cross-section can also be rectangular, e.g. square, with rounded or chamfered edges.

The rods can be assembled from tablets made from the compacted material.

The compact may also be flat, i.e. the zeolite crystal mass can be compacted to form plates which can be stacked, e.g. with interposition of spacers, in the tank acting as the methane-storage vessel.

If the material of the compact is not sufficiently stable to allow handling or use in vehicle applications, it can be supported within the tank, e.g. on hollow perforated profile members forming frames or braces which are disposed between the rods or other compact bodies and which not only afford mechanical stability but also facilitate access of the gas to the storage material and retrieval of the gas therefrom.

The geometric form of the compacts is in part determined by the time required for complete diffusion from a surface to the innermost regions of the body which, in turn, determines the charging and retrieval time for the methane. The spaces between the bodies, which form flow channels for the gas, should have cross-sections which allow flow at a rate at least equal to the diffusion time so that these flow cross-sections do not limit the charging of the compacts with methane or the withdrawal of methane from the compacts.

I have also found that materials which can pick up high concentrations of methane and store them within the lattice structure, e.g. between layers of atoms therein, are also effective for the purposes of the invention. Particularly useful materials in this class include graphite structures in which the interlayer space is increased, e.g. by the introduction of alkalis—preferably sodium—into the graphite lattice, such systems providing conventional intercalated compound structures.

Another structure of this type is formed by the 1,4-diazabicyclo-[2,2,2]-octane-montmorillonite system described by J. Shabtai et al at the 6th International Congress on Catalysis in London, 12–16 July 1976 (see *Proceedings of Sixth International Congress on Catalysis,* Vol. 2, pp. 660 ff.).

Silica gel with a pore volume fraction larger than that of zeolite crystals is a suitable methane storage material also.

The tank structure which can be used in accordance with this invention for packing densities of methane of about 10, at room temperature and at 10 bar methane pressure, should be portable and can correspond to the vehicular or portable tanks now used for propane and butane, i.e. gas bottles adapted to sustain a 10-bar gauge pressure.

It should be noted that without the use of methane-storage materials within the purview of the instant invention, tanks of the same volume but dimensioned to sustain pressures of up to 200 bar must be employed.

It is important for the present invention that the methane retrieval be accomplished by a simple pressure relief on the tank, i.e. that methane be withdrawn from the storage mass spontaneously upon reduction of the pressure to which the mass is subjected.

If necessary, however, the tank may also be heated to drive out additional quantities of methane and the tank heating according to the invention is preferably accomplished by engine heat, as by circulating the engine coolant into heat-exchange relationship with the tank or The contents thereof.

The heating may be initiated or intensified after the tank pressure has been somewhat lowered and to this end I have found it advantageous to provide temperature and pressure sensors in the tank and to control the heating of the latter by the engine coolant via a microprocessor responding to these sensors.

I also prefer to subdivide the fuel tank for a motor vehicle according to the invention into a plurality of compartments, sections or vessels which can be filled and emptied independently of one another so that one of these compartments, having released some of its stored methane at ambient temperature, can be individually heated to give up the remainder without requiring the heating of the entire storage mass or tank facility.

For the dimensioning of a fuel tank according to the invention the following considerations should be taken into account.

A cubic meter of methane (STP) is able to supply the same amount of energy in driving an internal-combustion engine as 1 kg (1.43 liter) of gasoline. A 1-liter gasoline tank is therefore equivalent to a 7-liter methane container filled with a packing density v=10 at 10 bar. With further improvement in methane-storage capacity, however, approximate volumetric parity appears to be within reach.

BRIEF DESCRIPTION OF THE DRAWING

The above and other features of my invention will become more readily apparent from the following description, reference being made to the accompanying drawing in which.

SPECIFIC DESCRIPTION

Figures 1, 2:
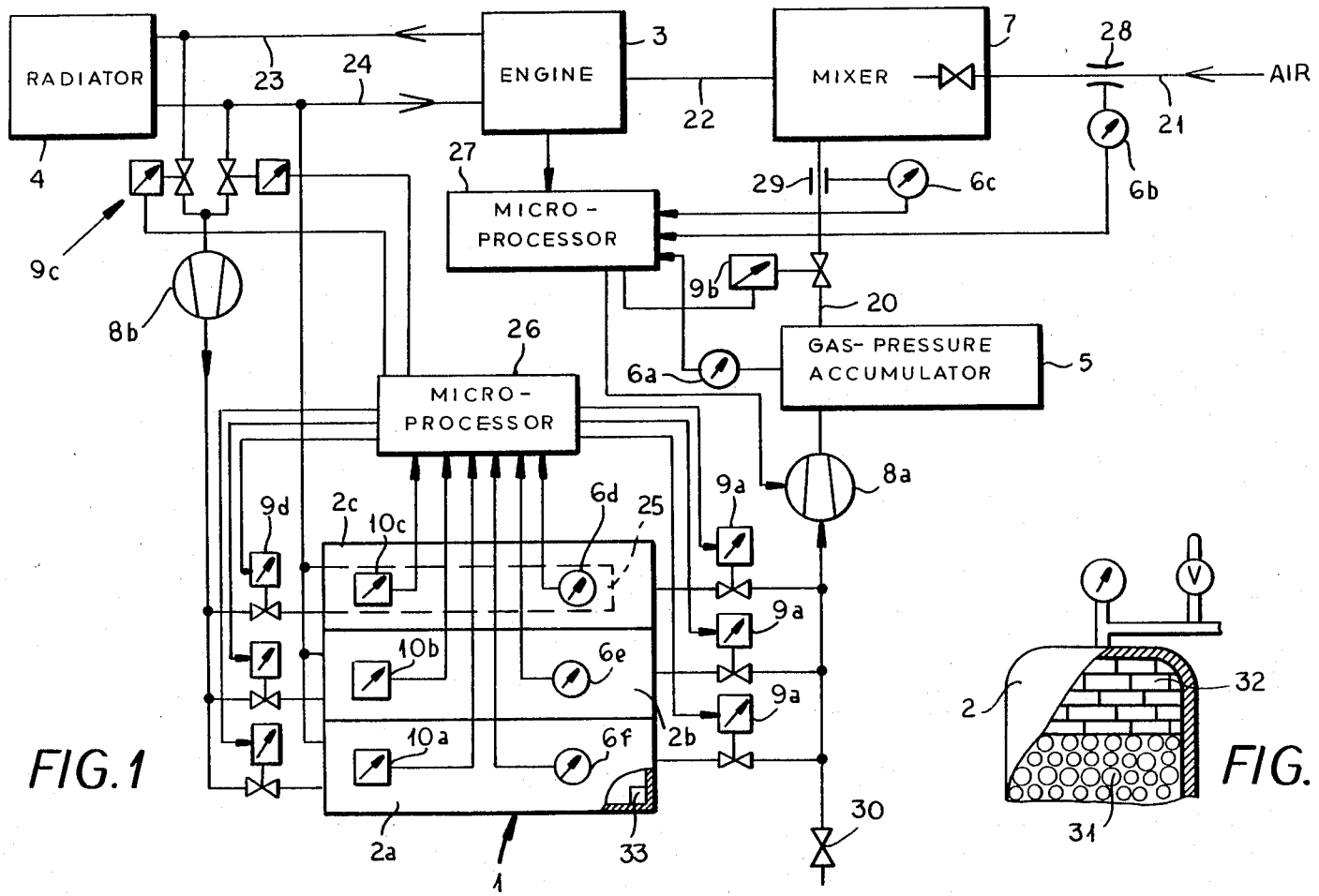
FIG. 1 is a diagram representing an engine system utilizing the principles of the present invention.
FIG. 2 shows a tank for the storage of methane in accordance with the invention, partly broken away.

FIG. 1 of the drawing shows a tank 1 for the storage of methane to power an automotive vehicle, the tank being subdivided into three vessels or compartments 2*a*, 2*b*, 2*c*. Each of these compartments is connected through a respective magnetic valve 9*a* with a pump 8*a* feeding a gas-pressure accumulator 5 provided with a pressure sensor 6*a*. From the accumulator 5 the fuel is fed via a line 20 and a magnetic valve 9*b* to a carburetor or other fuel/air mixer 7 to which air is supplied via a line 21 having a throttle 28 connected to a pressure sensor 6*b*. Another pressure sensor 6*c* can be linked with a throttle 29 in line 20.

The fuel/air mixture is delivered, as represented by a line 22, to the vehicular engine 3 which has a radiator or cooler 4 to which coolant is fed via line 23 and from which the coolant is returned by a line 24. A portion of the coolant can be branched by magnetic valves 9*c* to a pump 8*b* feeding magnetic valves 9*d* of several heating loops 25, one of which has been shown in FIG. 1 and which can be embedded in the methane-storage masses of the vessels 2.

Each vessel 2*a*–2*c* has a respective temperature sensor 10*a*, 10*b*, 10*c* working into a microprocessor 26 which also receives inputs from associated pressure sensors 6*d*, 6*e* and 6*f*. The magnetic valves 9*a*, 9*c* and 9*d* are controlled by the microprocessor 26 whereas a further microprocessor 27, responsive to the sensors 6*a*–6*c*, controls the pump 2*a* and the magnetic valve 9*b*. Engine-operation parameters may also be supplied to the microprocessor 27 in a conventional manner.

The microprocessors 26 and 27 cooperate in adapting the methane support to the methane demand in the accumulator 5.

In the initial phase of its operation, one of the vessels of tank 1—say, compartment 2*a*—is connected by its magnetic valve 9*a* to the pump 8*a*, the pressure accumulator 5 and the gas/air mixer 7 to supply the engine 3. The initial release of methane is spontaneous as a result of pressure reduction at the upstream side of pump 8*a* and engine operation continues in this mode until the temperature sensor 10*a* and the pressure sensor 6*f* indicate that insufficient methane is spontaneously released for effective further operation which, however, is not impeded because of the gas reserve available in the accumulator 5. The sensors 10*a* and 6*f* actuate the microprocessor 26 to bypass hot engine coolant from line 23 through vessel 2*a* to drive out additional methane, the coolant being returned to line 24. Operation continues in this mode until the sensors 10*a* and 6*f* again determine that insufficient methane is available, whereupon the valves 9*a* and 9*d* associated with that vessel are closed and the valve 9*a* of the next vessel—say, compartment 2*b*—is opened, the process being repeated until all of the methane is depleted or until the tank is refueled.

Such refueling can take place through a valve 30 at elevated pressure and with the engine heat cut off from the vessels. The microprocessor 27, of course, meters the flow of the fuel to the mixer 7 and controls its operation in accordance with engine conditions.

A representative vessel 2 shown in FIG. 2 is provided with a filling 31 of various sizes of granules of methane-storage material, as described, and with rods 32 constituting compacts of this material. When the tank is prismatic, the compacts may have similar cross-sections as shown at 33 in FIG. 1.

Specific Examples

EXAMPLE 1

A tablet press with cylindrical die was used to press compacts of a diameter of 12 mm of zeolite powder of the type CaX having a particle size of several microns. The powder used was SASIL CaX of Henkel AG, Dusseldorf, Germany. The press pressure was about 6 tons/cm$^2$ and the density of the tablets was 0.7 g/cm$^3$.

The tablets were introduced into a cylindrical vessel having a volume of 52 cm$^3$ which was practically filled with the tablets and charged with methane at a pressure of 10 bar. 2 g methane were taken up at room temperature with a specific storage rate of 0.04 g/cm$^3$.

EXAMPLE 2

Zeolite CaX in a microcrystalline form in a glass tube with an inner diameter of 12 mm was degassed at 300° C. under a high vacuum, the filling head of the tube was burned off and its contents were subjected to a temperature of 700° C. and a pressure of 100 bar in a pressure cell. The resulting zeolite compact had a density of 0.8 g/cm$^3$.

A storage test with methane at 10 bar showed a pickup at room temperature of 0.1 g of methane per cm$^3$, within the order of magnitude of the density of liquid methane whose value at room temperature is 0.47 g/cm$^3$.

In general, compacts with densities upwards of 0.7 g/cm$^3$ were found to be most effective.

I claim:

1. A methane-storage system for a methane-powered vehicle, comprising:

a pressure-retentive tank adapted to contain a pressure of up to about 15 bar; and a methane-storage filler in said tank consisting of a mass of binder-free compacts of zeolite having a density of at least 0.7 g/cm$^3$ and forming a solid adapted to hold methane with a minimum packing density of about 10, with respect to the empty tank, at room temperature and at a pressure of 10 bar.

2. The system defined in claim 1 wherein said zeolite is a type X calcium-ion-exchanged zeolite.

3. The system defined in claim 1 wherein said filler consists of bodies of different size for maximum packing of the interior of said tank.

4. The system defined in claim 1 wherein said tank is subdivided into a plurality of vessels each formed with conduit means for the individual heating of the contents thereof, said system further comprising control valves for connecting said conduit means to the cooling system of an internal-combustion engine and a microprocessor for operating said valves.

5. The system defined in claim 1 wherein zeolite is in the form of binder-free powder compacts having a density of at least 1 g/cm$^3$.

6. The system defined in clain 5 wherein said compacts are in the form of rods.

7. The system defined in claim 6 wherein said rods have different diameters in a range whose limits are in a ratio of about 1:0.4.

8. The system defined in claim 6 wherein said tank has a polygonal cross-section and said rods have cross-sections of the same geometric shape as said tank.

9. A method of operating an automotive vehicle having an internal-combustion engine and a cooling system for said engine, comprising the steps of:

(a) storing methane at a pressure of about 10 bar in a tank adapted to sustain a pressure of about 15 bar and containing a mass of binder-free compacts of zeolite having a density of at least 0.7 g/cm$^3$ and forming a methane-storage solid filling;

(b) fueling said engine with methane drawn from said tank by reducing the pressure therein until the pressure in said tank falls to a predetermined level; and (c) thereafter heating said tank indirectly with engine heat drawn from said cooling system to draw additional methane from said filling to operate said engine.

10. The system defined in claim 1 wherein said zeolite is a type A calcium-ion-exchanged zeolite.

* * * * *